United States Patent [19]

Hinkamp et al.

[11] 4,448,587

[45] May 15, 1984

[54] SYNERGISTIC CETANE IMPROVER

[75] Inventors: James B. Hinkamp, Birmingham, Mich.; John V. Hanlon, Baton Rouge, La.

[73] Assignee: Ethyl Corporation, Richmond, Va.

[21] Appl. No.: 479,507

[22] Filed: Mar. 28, 1983

[51] Int. Cl.[3] ..... C10L 1/22

[52] U.S. Cl. ..... 44/57

[58] Field of Search ..... 44/57; 260/466, 467

[56] References Cited

U.S. PATENT DOCUMENTS 2,031,497 2/1936 Marvel ..... 44/57
2,065,588 12/1936 Howes ..... 44/57

FOREIGN PATENT DOCUMENTS 479969 2/1938 United Kingdom ..... 44/57
535401 4/1941 United Kingdom ..... 44/57
993623 6/1965 United Kingdom ..... 44/57

*Primary Examiner*—Charles F. Warren
*Assistant Examiner*—Y. Harris-Smith
*Attorney, Agent, or Firm*—Donald L. Johnson; John F. Sieberth; Joseph D. Odenweller

[57] ABSTRACT

The cetane rating of diesel fuel is increased by addition of a small amount of the synergistic combination of (a) an alkyl-nitrate (e.g. octyl nitrates) and (b) the nitrate ester of an alkoxylated alcohol (e.g. ethoxyethyl nitrate).

14 Claims, No Drawings

SYNERGISTIC CETANE IMPROVER

BACKGROUND

Diesel engines operate by compression ignition. They have compression ratios in the range of 14:1 to 17:1 or higher and for that reason obtain more useful work from a given amount of fuel compared to a spark-ignited engine. Historically, diesel engines have been operated on a petroleum-derived liquid hydrocarbon fuel boiling in the range of about 300–750° F. Recently, because of dwindling petroleum reserves, alcohol and alcohol-hydrocarbon blends have been studied for use as diesel fuel.

One major factor in diesel fuel quality is cetane number. Cetane number is related to ignition delay after the fuel is injected into the combustion chamber. If ignition delay is too long, the amount of fuel in the chamber increases and upon ignition results in a rough running engine and increased smoke. A short ignition delay results in smooth engine operation and decreases smoke. Commercial petroleum diesel fuels generally have a cetane number of about 35–55. Alcohols have a much lower cetane value and require the addition of a cetane improver for successful engine operation.

Through the years, many types of additives have been proposed to raise the cetane number of diesel fuel. These include peroxides, nitrites, nitrates, nitrocarbamates, and the like. Alkyl nitrates such as amyl nitrate, hexyl nitrate and mixed octyl nitrates have been used commercially with good results. Likewise certain cyclohexyl nitrates and alkoxyalkyl nitrates have been suggested as cetane improvers for diesel fuel (Olin et al U.S. Pat. No. 2,294,849).

SUMMARY

According to the present invention it has now been discovered that the cetane number of diesel fuel can be synergistically increased by addition of the combination of (a) an alkyl or cycloalkyl nitrate and (b) an alkoxyalkyl nitrate.

DESCRIPTION OF PREFERRED EMBODIMENT

A preferred embodiment of the invention is a synergistic combination of organic nitrate cetane improvers comprising (a) about 5–95 weight percent of a $C_4$–$C_{12}$ alkylnitrate, $C_6$–$C_{12}$ cycloalkyl nitrate or mixtures thereof and (b) about 95–5 weight percent of an alkoxyalkyl nitrate of the formula $$R\text{-}(O\text{—}R')_n ONO_2$$

wherein R is an alkyl containing 1–10 carbon atoms, R' is a divalent alkylene group of 2–4 carbon atoms and n is an integer from 1–4.

Useful $C_4$–$C_{12}$ alkyl nitrates include
n-butyl nitrate
iso-butyl nitrate
n-pentyl nitrate
2-methyl butyl nitrate
3-methyl butyl nitrate
n-hexyl nitrate
2-methyl pentyl nitrate
3-methyl pentyl nitrate
2-ethyl butyl nitrate
n-heptyl nitrate
2-methyl hexyl nitrate 3-methyl hexyl nitrate
2-ethyl heptyl nitrate
2-ethyl pentyl nitrate
n-octyl nitrate
2-methyl heptyl nitrate
2-ethyl hexyl nitrate
2,3-dimethyl hexyl nitrate
n-nonyl nitrate
n-decyl nitrate
2-ethyl octyl nitrate
n-dodecyl nitrate
2-ethyl decyl nitrate
2,4-dimethyl decyl nitrate
and the like.

Representative $C_5$–$C_{12}$ cycloalkyl nitrates are
cyclopentyl nitrate
cyclohexyl nitrate
4-methyl cyclohexyl nitrate
2,4-dimethyl cyclohexyl nitrate
4-ethyl cyclohexyl nitrate
cyclooctyl nitrate
4-methyl cyclooctyl nitrate
cyclododecyl nitrate
and the like.

Of the above the more preferred are the primary alkyl nitrates containing 5–10 carbon atoms such as
n-pentyl nitrate
2-methyl butyl nitrate
3-methyl butyl nitrate
n-hexyl nitrate
2-methyl pentyl nitrate
2-ethyl butyl nitrate
n-heptyl nitrate
2-ethyl pentyl nitrate
n-octyl nitrate
2-ethyl hexyl nitrate
n-nonyl nitrate
n-decyl nitrate
2-ethyl octyl nitrate
and the like.

The more highly preferred alkyl nitrates are amyl nitrates (mixed primary pentyl nitrates), primary hexyl nitrates and primary octyl nitrates including all isomers, mixtures of isomers and mixtures of the amyl, hexyl and octyl nitrates. The most preferred alkyl nitrates are the primary octyl nitrates such as 2-ethyl hexyl nitrate and other isomers.

Representative alkoxyalkyl nitrates of the foregoing formula are
2-methoxyethyl nitrate
2-ethoxyethyl nitrate
2-propoxyethyl nitrate
2-butoxyethyl nitrate
2-hexoxyethyl nitrate
2-octoxyethyl nitrate
2-decyloxyethyl nitrate
2-(2-ethylhexyloxy)-ethyl nitrate
2-isobutoxyethyl nitrate
2-methoxypropyl nitrate
2-ethoxypropyl nitrate
2-butoxypropyl nitrate
2-isobutoxypropyl nitrate
2-decyloxypropyl nitrate
2-(2-ethylhexyloxy)-propyl nitrate
2-methoxybutyl nitrate
2-ethoxybutyl nitrate
2-isobutoxybutyl nitrate The alkoxyalkyl nitrates are nitric acid esters of the alcohols formed by reacting $C_1$–$C_{10}$ monohydric alcohols with $C_2$–$C_4$ alkylene oxides. Accordingly the higher members can be named as nitric acid esters of the various polyalkoxylated alcohols such as the nitrates of diethoxylated methanol $CH_3(O\ CH_2CH_2)_2ONO_2$ and diethoxylated ethanol $CH_3CH_2(O\ CH_2CH_2)_2\ ONO_2$. Other useful alkoxyalkyl nitrates are the nitric acid esters of diethoxylated butanol,
diethoxylated 2-ethylhexanol,
diethoxylated decanol,
dipropoxylated methanol,
dipropoxylated ethanol,
dipropoxylated isobutanol,
dipropoxylated 2-ethylhexanol,
dipropoxylated decanol,
dibutoxylated ethanol,
triethoxylated methanol,
triethoxylated ethanol,
triethoxylated isobutanol,
triethoxylated 2-ethylhexanol,
tripropoxylated methanol,
tripropoxylated ethanol,
tetraethoxylated methanol,
tetraethoxylated ethanol, and the like including mixtures of the nitrates of the above alkoxylated alcohols.

The nitrates can be readily made by known methods. For example, the corresponding alcohol can be converted to the nitrate by reaction with mixed nitric-sulfuric acid (e.g. 20 wt. % $HNO_3$–68 wt. % $H_2SO_4$), at low temperatures (e.g $-10°$ to 10° C.). Preferably the alcohol is slowly added to the vigorously stirred mixed acid. A stoichrometric excess of $HNO_3$ is used. The resultant reaction mixture is then poured into ice water and the organic layer neutralized and dried.

Alternatively with the more volatile nitrates such as amyl nitrate, methoxyethyl nitrate, ethoxyethyl nitrate, the alcohol can be slowly added to boiling aqueous nitric acid (approx. 30–40 wt. % $HNO_3$) containing about 3–10 wt. % urea to destroy any nitrous acid that might form. The distillate forms two phases. The organic phase will contain the nitrate.

The alcohols can be added in an inert solvent to facilitate the reaction and inhibit destructive oxidation. Any solvent can be used that is insert under the reaction conditions and which will dissolve the alcohols and/or nitrates. Solvents such as methylene chloride and chloroform can be used.

The ratio of (a) alkyl or cycloalkyl nitrate to (b) alkoxyalkyl nitrate can vary over a wide range. The ratio should be adjusted to achieve the optimum economic balance based on cost and effectiveness. A useful range in which to experiment is from about 5–95 weight percent alkyl or cycloalkyl nitrate to about 95–5 weight percent alkoxyalkyl nitrate. A more preferred ratio is about 30–70 weight percent alkyl or cycloalkyl nitrate and about 70–30 weight percent alkoxyalkyl nitrate. Excellent results have been achieved in the case of octyl nitrates and 2-ethoxyethyl nitrate using a 50–50 weight percent mixture.

Petroleum derived distillate fuels in the diesel boiling range require only small amounts of cetane improver to achieve a significant increase in cetane number. Such fuels without any cetane improver generally have cetane numbers in the range of about 25–60. Cetane numbers in the range of 25–35 are considered low and those in the range of 50–60 are considered top grade diesel fuels. Diesel fuels in the 35–50 mid-range are most common. An object of the invention is to upgrade the low cetane number fuels at least into the mid-range and to increase the cetane value of the mid-range fuels into the upper portion of the mid-range (e.g. 45–50) or even into the premium range above 50. It has been found that highly beneficial results can be achieved using as little as 0.02 weight percent of the present additive. Accordingly, a useful concentration range in petroleum derived diesel fuel is about 0.01–5 weight percent and preferably about 0.02–0.5 weight percent.

Petroleum refiners generally have a cetane specification for various grades of diesel fuel. With paraffinic crudes this value can usually be met or exceeded by refining methods. However with aromatic crudes the target cetane value can be difficult or impossible to meet by refining alone. With either type or with blends of parrafinic and aromatic fuels it is more expedient to refine or blend a fuel having a cetane value below target and then raise the cetane number by the addition of a cetane improver. Hence in a practical application the amount of cetane boost required is known or fixed and the variable is the concentration of cetane improver required to give the required cetane boost. Thus if the target is a 45 cetane fuel and the refined diesel fuel has a natural cetane number of 40 the required boost is 5 cetane numbers no matter what cetane improver is used. What will vary is the concentration of different cetane improvers that is required to give the required 5 cetane boost. If one cetane improver will give the required boost at a concentration of 0.2 weight percent and a second cetane improver will give the same 5 cetane boost at a concentration of 0.15 weight percent then the second more effective cetane improver is said to have a Relative Effectiveness (RE) of 1.33 compared to the first less effective cetane improver. This RE is extremely important in the economics of cetane improvers because a higher cost cetane improver with a high RE can actually be the least expensive way to obtain whatever cetane boost is required.

In order to determine RE a mathematical relationship was developed for many different cetane improvers based on cetane increase and additive concentration. Using this relationship the RE of any new cetane improver compared to a standard additive (e.g. isooctyl nitrate) can be determined by measuring the cetane response caused by the new additive and the standard additive at the same concentration in the same diesel fuel.

Using the above test program the RE of isooctyl nitrate, 2-ethoxyethyl nitrate and several mixtures thereof were calculated to be as in the following table:

TABLE I

| Weight Ratio[1] | RE Value |
|---|---|
| 0/100 | 1.00 |
| 30/70 | 1.14 |
| 50/50 | 1.25 |
| 100/0 | 1.37 |

[1]2-ethoxyethyl nitrate/isooctyl nitrate

According to this data on average the cost of 2-ethoxyethyl nitrate could be 1.37 times the cost of isooctyl on a weight basis and both would be equal on a cost-effectiveness basis. However a surprising response occurs when mixture of the two are used. A 50/50 weight mixture gave an RE of 1.25. A linear relationship in RE between 0/100 (RE 1.00) and 100/0 (RE 1.37) would give an expected RE for a 50/50 blend of 1.185. The actual RE was 1.25 or 0.065 units higher than could be expected. This represents a 5.5 percent increase in RE compared to what was expected. The economic consequences of this could be very significant. For example if the cost of isooctyl nitrate were $1.00 per unit weight and the cost of 2-ethoxyethyl nitrate was $1.37 per unit weight then the two would be of equal cost effectiveness. There would be no cost advantage to either one.

Now a 50/50 weight blend of the two would cost $1.185 per unit weight. However it would give a cetane boost 5.5 percent more than expected so under these conditions would make the 50/50 blend clearly the better economic choice.

A similar situation prevails at the 30/70 blend (RE 1.14). A linear response between isooctyl nitrate (RE 1.0) and 2-ethoxyethyl nitrate (RE 1.37) would predict for the 30/70 blend an RE of 1.11. The actual RE is 0.03 units or 2.7 percent above that which would be predicted.

In order to confirm the above RE results a direct comparison of isooctyl nitrate vs a 50/50 mixture of isooctyl nitrate and 2-ethoxyethyl nitrate was conducted in the same 37.2 cetane diesel fuel. The isooctyl nitrate was added to give 0.15 weight percent concentration and the 50/50 mixture was rated at only 0.11 weight percent.

| Additive | Conc (wt %) | Cetane No. |
|---|---|---|
| 1. isooctyl nitrate | 0.15 | 41.7 |
| 2. 50/50 mix of isooctyl nitrate and 2-ethoxy ethyl nitrate | 0.11 | 41.5 |

These results confirm that the mixture has an RE much greater than would be predicted.

The synergistic mixtures described herein have a further beneficial property. some of the alkoxyalkyl nitrates tend to be somewhat shock sensitive. For example, in the Olin Matheson Drop Weight Test, 2-ethoxyethyl nitrate has a 50% probability of explosion at 6.6 Kg cm drop-weight. However the 50/50 synergistic mixture with isooctyl nitrates has rating of >40 Kg cm drop-weight in the same test. Thus not only do the mixtures give a greater cetane response than could be expected but they also have a much lower sensitivity to shock.

We claim:

1. A synergistic combination of organic nitrate cetane improvers comprising (a) about 5–95 weight percent of a $C_4$–$C_{12}$ alkylnitrate, $C_5$–$C_{12}$ cycloalkyl nitrate or mixtures thereof and (b) about 95–5 weight percent of an alkoxyalkyl nitrate of the formula $$R\text{-}(O\text{—}R')_n ONO_2$$

wherein R is an alkyl containing 1–10 carbon atoms, R′ is a divalent alkylene group of 2–4 carbon atoms and n is an integer from 1–4.

2. A combination of claim 1 comprising (a) about 5–95 weight percent of a primary $C_{5-10}$ alkyl nitrate and (b) about 95–5 weight percent of an alkoxyalkyl nitrate wherein R is an alkyl group containing 1–4 carbon atoms, R′ is —$CH_2CH_2$— and n is 1.

3. A combination of claim 2 wherein said alkoxyalkyl nitrate is ethoxyethyl nitrate.

4. A combination of claim 3 comprising (a) about 30–70 weight percent $C_{5-10}$ alkyl nitrate and (b) about 70–30 weight percent ethoxyethyl nitrate.

5. A combination of claim 4 comprising (a) about 30–70 weight percent amyl nitrate and (b) about 70–30 weight percent ethoxyethyl nitrate.

6. A combination of claim 5 comprising (a) about 30–70 weight percent hexyl nitrates and (b) about 70–30 weight percent ethoxyethyl nitrate.

7. A combination of claim 6 comprising (a) about 30–70 weight percent octyl nitrates and (b) about 70–30 weight percent ethoxyethyl nitrate.

8. A distillate fuel of the diesel boiling range containing a cetane number increasing amount of the synergistic combination of (a) about 5–95 weight percent of a $C_4$–$C_{12}$ alkylnitrate, $C_6$–$C_{12}$ cycloalkyl nitrate or mixtures thereof and (b) about 95–5 weight percent of an alkoxyalkyl nitrate of the formula $$R\text{-}(O\text{—}R')_n ONO_2$$

wherein R is an alkyl containing 1–10 carbon atoms, R′ is a divalent alkylene group of 2–4 carbon atoms and n is an integer from 1–4.

9. A fuel of claim 8 wherein said synergistic cetane improver comprises (a) about 5–95 weight percent of a primary $C_{5-10}$ alkyl nitrate and (b) about 95–5 weight percent of an alkoxyalkyl nitrate wherein R is an alkyl group containing 1–4 carbon atoms, R′ is —$CH_2CH_2$— and n is 1.

10. A fuel of claim 9 wherein said alkoxyalkyl nitrate is ethoxyethyl nitrate.

11. A fuel of claim 10 wherein said synergistic cetane improvers comprise (a) about 30–70 weight percent $C_{5-10}$ alkyl nitrate and (b) about 70–30 weight percent ethoxyethyl nitrate.

12. A fuel of claim 11 wherein said synergistic cetane improvers comprise (a) about 30–70 weight percent amyl nitrates and (b) about 70–30 weight percent ethoxyethyl nitrate.

13. A fuel of claim 11 wherein said synergistic cetane improvers comprise (a) about 30–70 weight percent hexyl nitrates and (b) about 70–30 weight percent ethoxyethyl nitrate.

14. A fuel of claim 11 wherein said synergistic cetane improvers comprise (a) about 30–70 weight percent octyl nitrates and (b) about 70–30 weight percent ethoxyethyl nitrate.

* * * * *

UNITED STATES PATENT AND TRADEMARK OFFICE

CERTIFICATE OF CORRECTION

PATENT NO. : 4,448,587

DATED : May 15, 1984

INVENTOR(S) : JAMES B. HINKAMP ET AL.

It is certified that error appears in the above-identified patent and that said Letters Patent is hereby corrected as shown below:

Column 1, line 24, reads "35-55", should read --38-55--.

Column 3, line 47, reads "insert", should read --inert--.

Signed and Sealed this

*Second* Day of *October 1984*

[SEAL]

*Attest:*

GERALD J. MOSSINGHOFF

*Attesting Officer*

*Commissioner of Patents and Trademarks*